US008087480B2

(12) United States Patent
Blangé

(10) Patent No.: US 8,087,480 B2
(45) Date of Patent: Jan. 3, 2012

(54) DEVICE AND METHOD FOR FEEDING PARTICLES INTO A STREAM

(75) Inventor: Jan-Jette Blangé, Rijswijk (NL)

(73) Assignee: Shell Oil Company, Houston, TX (US)

( * ) Notice: Subject to any disclaimer, the term of this patent is extended or adjusted under 35 U.S.C. 154(b) by 668 days.

(21) Appl. No.: 12/094,028

(22) PCT Filed: Nov. 16, 2006

(86) PCT No.: PCT/EP2006/068539
§ 371 (c)(1),
(2), (4) Date: May 16, 2008

(87) PCT Pub. No.: WO2007/057426
PCT Pub. Date: May 24, 2007

(65) Prior Publication Data

US 2010/0243240 A1 Sep. 30, 2010

(30) Foreign Application Priority Data

Nov. 18, 2005 (EP) ..... 05257119

(51) Int. Cl.
*E21B 7/16* (2006.01)

(52) U.S. Cl. ..... 175/380; 175/67; 166/248

(58) Field of Classification Search ..... 166/248, 166/66.5; 175/380, 67, 393; 210/222; 209/219, 209/226, 227, 231; 335/302
See application file for complete search history.

(56) References Cited

U.S. PATENT DOCUMENTS

| | | | | |
|---|---|---|---|---|
| 3,506,023 | A | 4/1970 | Bogart | 137/81.5 |
| 3,815,286 | A | 6/1974 | Piet | 51/12 |
| 3,838,742 | A | 10/1974 | Juvkam-Wold | 175/380 |
| 3,852,200 | A * | 12/1974 | Meyer | 507/112 |
| 4,082,207 | A | 4/1978 | Garnier et al. | 222/594 |
| 4,216,800 | A | 8/1980 | Garnier et al. | 137/807 |
| 4,324,266 | A | 4/1982 | Garnier et al. | 137/13 |
| 4,934,458 | A * | 6/1990 | Warburton et al. | 166/370 |
| 5,465,789 | A | 11/1995 | Evans | 166/248 |
| 6,044,858 | A | 4/2000 | Nathenson | 137/13 |
| 6,510,907 | B1 | 1/2003 | Blange | 175/67 |
| 6,702,940 | B2 | 3/2004 | Blange | 210/222 |
| 7,017,684 | B2 | 3/2006 | Blange | 175/424 |
| 7,322,433 | B2 | 1/2008 | Blange | 175/424 |

FOREIGN PATENT DOCUMENTS

| | | |
|---|---|---|
| EP | 1175546 | 1/2002 |
| GB | 2042399 | 9/1980 |
| JP | 62028173 | 2/1987 |
| WO | WO0066872 | 11/2000 |
| WO | WO0225053 | 3/2002 |

(Continued)

OTHER PUBLICATIONS

International Search Report dated Mar. 16, 2007 (PCT/EP2006/068539).
U.S. Appl. No. 10/563,887, filed Jan. 9, 2006.
U.S. Appl. No. 10/563,898, filed Jan. 9, 2006.

(Continued)

*Primary Examiner* — William P Neuder
*Assistant Examiner* — Yong-Suk Ro

(57) ABSTRACT

A device is provided for feeding a plurality of particles into a stream at a controlled rate, the device comprising a conduit having a flow passage for feeding the particles into the stream, and pulsating means for inducing a pulsed flow of the particles through the flow passage.

13 Claims, 3 Drawing Sheets

FOREIGN PATENT DOCUMENTS

| | | |
|---|---|---|
| WO | WO02/34653 | 5/2002 |
| WO | WO2005005765 | 1/2005 |
| WO | WO2005005766 | 1/2005 |
| WO | WO2005005767 | 1/2005 |
| WO | WO2007057426 | 5/2007 |

OTHER PUBLICATIONS

U.S. Appl. No. 10/563,899, filed Jan. 9, 2006.
U.S. Appl. No. 10/576,855, filed Apr. 19, 2006.
U.S. Appl. No. 10/577,456, filed Apr. 27, 2006.

* cited by examiner

Fig.3.
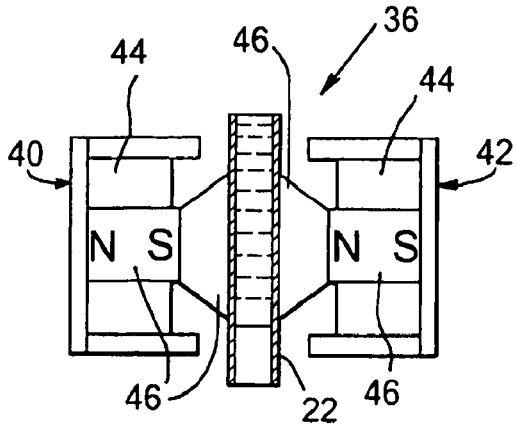
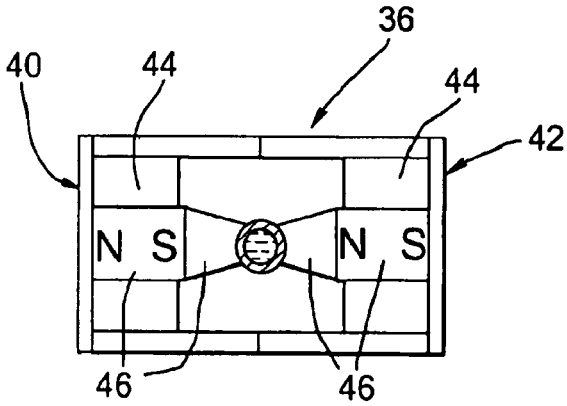
Fig.4.
Fig.5.
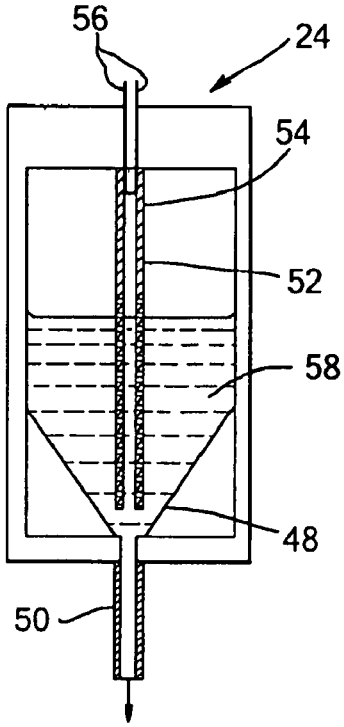

DEVICE AND METHOD FOR FEEDING PARTICLES INTO A STREAM

The present application claims priority from European Patent Application 05257119.7 filed 18 Nov. 2005.

FIELD OF THE INVENTION

The present invention relates to a device and a method for feeding a plurality of particles into a stream at a controlled rate.

BACKGROUND OF THE INVENTION

The use of abrasive particles in a stream of drilling fluid to drill a wellbore has been proposed as an alternative to conventional drilling methods such as rotary drilling with a roller-cone drill bit or a PDC drill bit. In such alternative drilling method a jetting device ejects a high velocity stream of a mixture of drilling fluid and abrasive particles against the bottom of the borehole thereby deepening the borehole.

U.S. Pat. No. 3,838,742 discloses a drill string provided with a drill bit having a number of outlet nozzles. Drilling fluid containing abrasive particles is pumped via the drill string through the nozzles thereby producing high velocity jets impacting against the borehole bottom. The abrasive particles accelerate the erosion process when compared to jetting of drilling fluid only. The rock cuttings are entrained into the stream that returns to surface through the annular space between the drill string and the borehole wall. After removal of the rock cuttings from the stream, the pumping cycle is repeated. However, this system has the drawback that continuous circulation of the abrasive particles through the pumping equipment and the drill string leads to accelerated wear of these components. Another drawback of the known system is that constraints are imposed on the rheological properties of the drilling fluid, for example a relatively high viscosity is required for the fluid to transport the abrasive particles upwardly through the annular space.

European patent 1175546 discloses a drill string provided with a drill bit having a plurality of outlet nozzles through which a mixture of drilling fluid and abrasive particles is ejected against the borehole bottom. The lower part of the drill string is provided with a recirculation assembly for recirculating the abrasive particles in the lower portion of the borehole. The re-circulation system catches the abrasive particles as these flow upwards through the annular space between the drill string and the borehole wall, and re-circulates the abrasive particles through the lower end part of the drill string and the outlet nozzles. Damage to the pumps and the upper part of the drill string due to contact with the abrasive particles is thereby substantially prevented.

However it was found that a minor portion of the abrasive particles bypasses the recirculation system and flows upwardly to surface through the annular space. If the loss of abrasive particles is not compensated, a decreasing amount of abrasive particles remains available for deepening the borehole. It also was found that compensating for the loss of particles by feeding low amounts of particles into the stream at surface via a feed device having a narrow flow opening, potentially leads to blocking of the narrow flow opening with abrasive particles.

It is therefore an object of the invention to provide an improved device for feeding particles into a stream, which device overcomes the drawback of the prior art.

SUMMARY OF THE INVENTION

In accordance with the invention there is provided a device for feeding a plurality of particles into a stream at a controlled rate, the device comprising a conduit having a flow passage for feeding the particles into the stream, and pulsating means for inducing a pulsed flow of the particles through the flow passage.

In another aspect of the invention there is provided a method of feeding a plurality of particles into a stream at a controlled rate, the method comprising feeding the particles into the stream via a flow passage of a conduit, and inducing a pulsed flow of the particles through the flow passage.

By feeding the particles into the stream in a pulsed flow mode, it is achieved that the velocity of the particles during each flow pulse can be kept relatively high while the time-average velocity can be kept relatively low. This has the advantage that a flow passage of relatively large diameter can be used, which minimizes the risk of blocking of the passage with particles. For example, such pulsed flow implies that a flow passage with a diameter of typically five times the particles diameter can be applied, whereas for continuous flow (i.e. non-pulsating flow) a flow opening significantly smaller than five times the particles diameter would be required to achieve the same (low) time-average velocity.

In a preferred embodiment the particles have a magnetic susceptibility, and the pulsating means comprises a magnetic field generator arranged to induce a pulsed magnetic field in the flow passage. The magnetic field captures the particles in the conduit and thereby stops, or slows down, the flow of particles through the conduit.

Suitably the pulse duration or the pulse frequency of the magnetic field is controlled to control the pulsed magnetic field in the flow passage. If for example the amount of particles fed into the stream during each pulse is kept constant, the time-average feed velocity simply can be controlled by controlling the pulse frequency. Thus, by measuring the amount of particles fed into the stream during one pulse (or a few pulses) the desired time-average feed velocity can be controlled by adjusting the pulse frequency in linear dependence of the measured amount.

Preferably the magnetic field generator comprises at least one electromagnet.

BRIEF DESCRIPTION OF THE DRAWINGS

The invention will be described hereinafter in more detail and by way of example, with reference to the accompanying drawings in which:

FIG. 3 schematically shows a longitudinal section of a coil assembly used in the device of FIG. 1;

FIG. 4 schematically shows a top view of the coil assembly of FIG. 3; and FIG. 5 schematically shows an injection vessel for abrasive particles used in the device of FIG. 1.

In the Figures like reference numerals relate to like components.

DETAILED DESCRIPTION OF THE INVENTION

Figure 1:
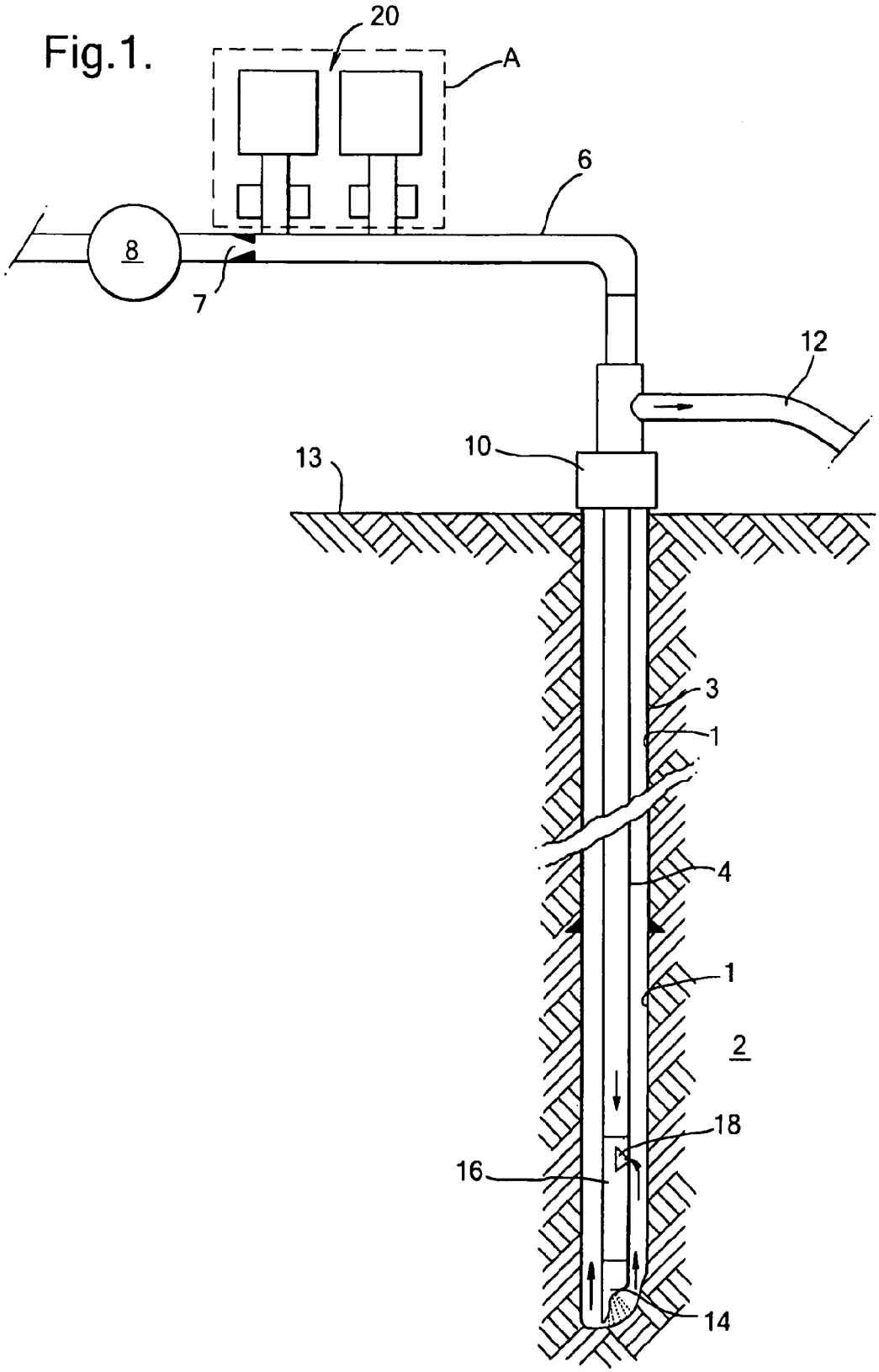
FIG. 1 schematically shows a drilling system for drilling a borehole in an earth formation, provided with an embodiment of the device of the invention.

Referring to FIG. 1 there is shown a drilling system for drilling a borehole 1 in an earth formation 2, comprising a drill string 4 extending into the borehole 1, a fluid supply conduit 6 for supplying drilling fluid to the drill string, and a pump 8 arranged to pump drilling fluid via the fluid supply conduit 6 and the drill string 4 into the borehole. One or more casings 3 are arranged in the borehole 1 in a known manner.

The fluid supply conduit 6 is internally provided with a nozzle or similar flow restriction 7. The upper end of the borehole 1 is provided with a conventional blowout preventer (BOP) 10 and an outlet 12 for drilling fluid at surface 13. A nozzle 14 for injecting a stream of drilling fluid and steel abrasive particles into the borehole 1 is provided at the lower end of the drill string 4. Furthermore, the drill string 4 includes a recirculation device 16 for re-circulating abrasive particles in the borehole. The recirculation device 16 is located a short distance above the lower end of the drill string 4, and includes an inlet opening 18 for abrasive particles. The recirculation system 16 serves to recirculate a major portion of the injected abrasive particles in a lower portion of the borehole 1. The details of the recirculation system 16 are beyond the scope of this description, however the reader may refer to WO 2005005765, WO 2005005766 or WO 2005005767 for suitable examples of recirculation systems, the disclosure of which is incorporated herein by reference.

Figure 2:
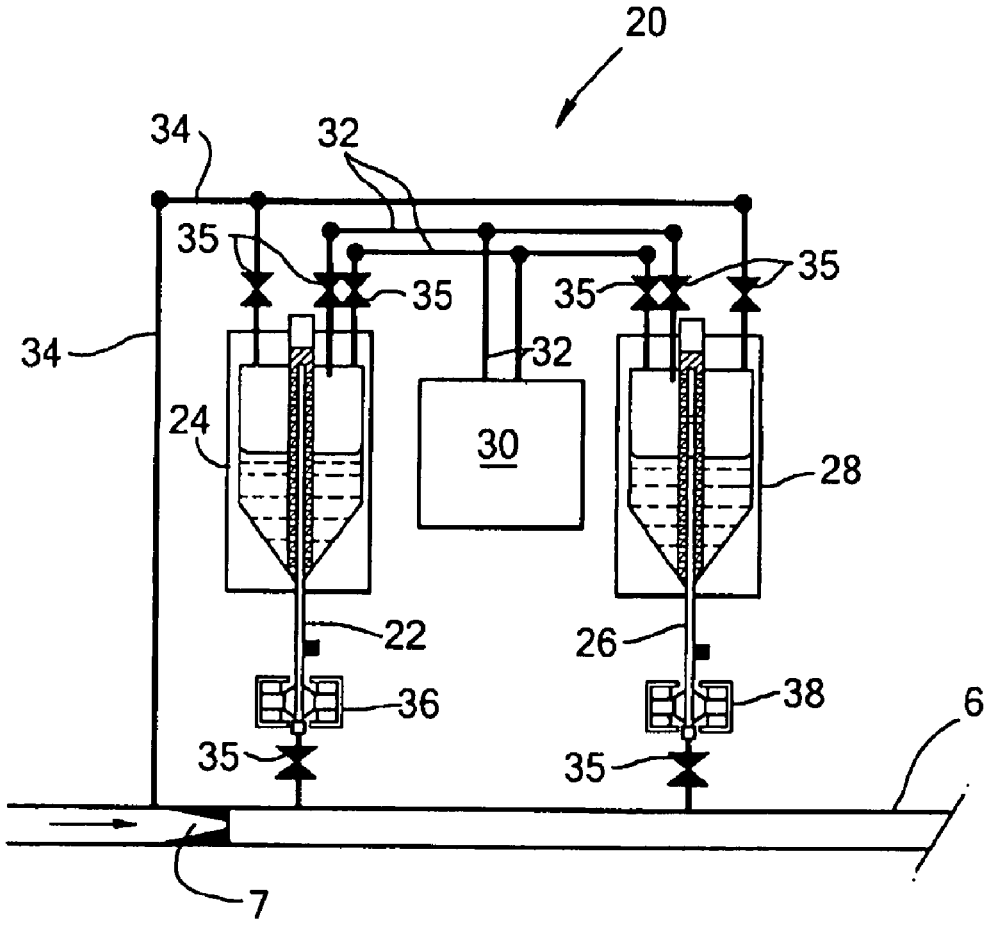
FIG. 2 schematically shows detail A of FIG. 1.

Referring further to FIG. 2 there is shown detail A of FIG. 1 indicating a feed assembly 20 for feeding steel abrasive particles, such as steel shot or steel grit particles, into the fluid supply conduit 6. The feed assembly 20 includes a first feed tube 22 at one end in fluid communication with the fluid supply conduit 6 downstream of the nozzle 7, and at the other end in fluid communication with a first injection vessel 24 containing abrasive particles. The feed assembly 20 furthermore includes a second feed tube 26 at one end in fluid communication with the fluid supply conduit 6 downstream of the nozzle 7, and at the other end in fluid communication with a second injection vessel 28 containing abrasive particles. The injection vessels 24, 28 are fluidly connected to a refill vessel 30 via a series of tubes 32, and the upper ends of the respective injection vessel 24, 28 are fluidly connected to the fluid supply conduit 6 at a point upstream of the nozzle 7 via a tube 34. A series of valves 35 is provided for selectively closing the various tubes 22, 26, 32, 34.

The feed tubes 22, 26 are furthermore provided with respective first and second magnetic valves 36, 38. The first magnetic valve 36 is shown in more detail in FIGS. 3 and 4, whereby it is noted that the second magnetic valve 38 is identical to the first magnetic valve 36. Magnetic valve 36 includes a pair of electromagnets 40, 42 arranged at opposite sides of the feed tube 22 in a manner that the feed tube 22 is adjacent the N-pole of one of the electromagnets and the S-pole of the other electromagnet, each electromagnet 40, 42 having a coil 44 and a yoke 46. The electromagnets 40,42 are connected to a control system (not shown) set up to supply a pulsed electric current from a current source to the electromagnets.

Referring further to FIG. 5 there is shown the first injection vessel 24 in more detail, whereby it is noted that the second injection vessel 28 is identical to the first injection vessel 24. Injection vessel 24 has an internal funnel 48 and an outlet for abrasive particles 50 in fluid communication with feed tube 22. Furthermore, injection vessel 24 is internally provided with a level sensor 52 comprising a tube 54 provided with a coil (not shown) extending in longitudinal direction of the tube 54. The coil is electrically connected to a control device (not shown) via electric wires 56. A volume of steel abrasive particles 58 is contained in the injection vessel 24.

During normal operation, the drill string 4 is rotated and simultaneously a stream of drilling fluid and steel abrasive particles is pumped into the drill string 4. The stream is ejected via the nozzle 14 against the borehole bottom so as to further deepen the borehole 1. The drilling fluid returns through the annulus between the drill string 4 and the borehole wall to surface where it is discharged via the outlet 12. Most of the abrasive particles flow into the inlet opening 18 of the recirculation system 16 during upward flow of the stream and thereby are re-circulated in the lower part of the borehole 1. By re-circulating abrasive particles in the lower part of the borehole 1 it is achieved that wear of the drilling assembly due to contact with the abrasive particles, is reduced.

However, a minor portion of the abrasive particles bypasses the recirculation system 16 and flows with the drilling fluid back to surface. In order to compensate for such backflow of abrasive particles, the magnetic valves 36, 38 of the feed assembly 20 are operated to inject a controlled amount of abrasive particles into the fluid supply conduit 6. To this end the control system supplies a pulsed current to the electromagnets 40, 42 thereby inducing a pulsating magnetic field in the feed tubes 22, 26. When the magnetic field is switched on, the steel abrasive particles inside the feed tubes 22, 26 are captured and block the flow through the feed tubes. When the magnetic field is switched off, the magnetic field decays and the abrasive particles flow through the feed tubes 22, 26 as a result of both gravity and a pressure difference between the injection vessels 24, 28 and the fluid supply conduit 6 caused by a pressure drop across the flow restriction 7 in the fluid supply conduit 6. Thus, by controlling the current pulses, the flow of abrasive particles from the injection vessels 24, 28 into the fluid supply conduit 6 can be accurately controlled so as to compensate for abrasive particles bypassing the recirculation system 16.

At each point in time, abrasive particles are fed into the fluid supply conduit 6 from one injection vessel 24, 28 only while the other injection vessel 24, 28 is refilled with abrasive particles, and vice versa. Thus, the magnetic valves 36, 38 are operated in alternating order. Refilling of the injection vessels 24, 28 is done from the refill vessel 30, by opening or closing selected valves of the series of valves 35. The level sensors 52 are used to measure the level of abrasive particles in the respective injection vessels 24, 28 by measuring the self-inductance of the coils present in the tubes 54. Such measurement is based on the variation of the self-inductance of the coils with the level of abrasive particles. The self-inductance of a coil when submerged in steel shot abrasive particles typically is a factor 5.6 higher than when submerged in air or water.

EXAMPLE

A magnetic valve 36 has a pair of electromagnets 40, 42 as described hereinbefore. The coils 44 of the electromagnets, which generate the magnetic field in the feed tube 22, are electrically connected in parallel and magnetically connected in series. This configuration has the same electrical response characteristics as a magnetic valve having a single coil with inductance L and resistance R. It is known that, after switching off the power supply to such coil, the decay of current flowing through the coil is:

$$I(t)=I(t_0)\cdot e(-t')$$

wherein t=time $t_0$=time at which the current has been switched off $$t'=R\cdot(t-t_0)/L$$

For a coil with: L=880 mH and R=32Ω, the time corresponding to a current decay of a factor $e^2$ is 2*L/R=54 ms. In view thereof it is preferred that the duration that the current is switched off (hereinafter: gate duration) is larger than 54 ms in order to establish a period without a magnetic field. More preferably the gate duration exceeds 100 ms. Switching on of the magnetic field requires a similar reaction time. The frequency of the electric pulses does not exceed 1/T, wherein T=gate duration+reaction time. The actual reaction time depends on the magnetic field strength at which the magnetic valve cannot stop the flow of abrasive particles anymore. This critical magnetic field strength depends on the operational conditions. In view thereof the pulse frequency preferably is kept below 1/T', wherein T'=2*gate duration. This implies that, for a gate duration of 100 ms, the pulse frequency is about 5 Hz or smaller.

The reaction time after switching off of each coil 44 can be shortened, for example, by connecting a resistor and a diode in parallel to the coil. Suitably the diode is a Zener diode to limit the voltage across the coil. Furthermore, a current source for powering the coils 44 is preferred over a voltage source. A voltage limited current source is most preferred as it allows the current through the coils 44 to be controlled substantially in step changes, while limiting the voltage differential to an acceptable range.

What is claimed is:

1. A device for feeding a plurality of particles into a stream at a controlled rate, the device comprising:

a conduit having a flow passage for feeding the particles into the stream, said conduit being in fluid communication between an injection vessel containing the particles and a drill string containing the stream; and a magnetic field generator arranged and controlled so as to induce a pulsed magnetic field in the flow passage so as to induce a pulsed flow of the particles through the flow passage;

wherein the particles have a magnetic susceptibility and are abrasive particles;

wherein the stream is a stream of drilling fluid flowing through the drill string extending into a borehole formed in an earth formation and the device is arranged to feed the particles into the stream of drilling fluid; and wherein the drill string is provided with a recirculation system for re-circulating abrasive particles in the borehole and the device is adapted to feed abrasive particles into the stream of drilling fluid at a rate corresponding to a rate at which abrasive particles bypass the recirculation system.

2. The device of claim 1, further comprising a control system adapted to control the pulsed magnetic field induced by the magnetic field generator in the flow passage.

3. The device of claim 2, wherein the control system is adapted to control at least one of the pulse duration and the pulse frequency of the pulsed magnetic field.

4. The device of claim 2, wherein the magnetic field generator comprises at least one electromagnet.

5. The device of claim 4, wherein a plurality of said electromagnets is provided including a first electromagnet and a second electromagnet, whereby the conduit is arranged between said first and second electromagnets.

6. The device of claim 4, wherein the control system comprises a current source arranged to supply an electric current to each electromagnet.

7. The device of claim 6, wherein the control system further comprises means for controlling the magnitude of said electric current.

8. The device of claim 1, wherein the injection vessel is provided with a level sensor for determining the level of particles in the injection vessel.

9. The device of claim 8, wherein the level sensor includes an electromagnetic coil having a self-inductance depending on the level of particles in the coil, and means for measuring said self-inductance of the coil.

10. The device of claim 1 wherein when the magnetic field is switched on, particles inside the conduit are captured and block the flow of particles from the injection vessel and when the magnetic field is switched off, the abrasive particles flow from the injection vessel.

11. A method of feeding a plurality of particles into a stream at a controlled rate, the method comprising:

providing a conduit in fluid communication between an injection vessel containing the particles and a drill string containing the stream feeding the particles into the stream via a flow passage of a conduit; and controlling a magnetic field generator to induce a pulsed flow of the particles through the flow passage, wherein the particles have a magnetic susceptibility and said pulsed flow is induced by inducing a pulsed magnetic field in the flow passage;

wherein the stream is a stream of drilling fluid flowing through the drill string extending into a borehole formed in an earth formation and the device is arranged to feed the particles into the stream of drilling fluid; and wherein the drill string is provided with a recirculation system for re-circulating abrasive particles in the borehole and the device is adapted to feed abrasive particles into the stream of drilling fluid at a rate corresponding to a rate at which abrasive particles bypass the recirculation system.

12. The method of claim 11, wherein the step of controlling the pulsed magnetic field comprises controlling at least one of the pulse duration and the pulse frequency of the pulsed magnetic field.

13. The method of claim 11 wherein when the magnetic field is switched on, particles inside the conduit are captured and block the flow of particles from the injection vessel and when the magnetic field is switched off, the abrasive particles flow from the injection vessel.

* * * * *